United States Patent [19]

Tyner

[11] Patent Number: 4,809,626

[45] Date of Patent: Mar. 7, 1989

[54] SHIRT

[76] Inventor: Alvin Tyner, 5128 NE. 36th St., Kansas City, Mo. 64117

[21] Appl. No.: 81,987

[22] Filed: Aug. 4, 1987

[51] Int. Cl.[4] ..... A41B 1/00

[52] U.S. Cl. ..... 2/115; 2/103

[58] Field of Search ..... 2/115, 103, 46, 116, 2/118, 121, 144

[56] References Cited

U.S. PATENT DOCUMENTS

| | | | |
|---|---|---|---|
| 394,270 | 12/1888 | Holmes | 2/116 |
| 458,266 | 8/1891 | Broom . | |
| 1,753,551 | 4/1930 | Corbi . | |
| 1,872,118 | 8/1932 | Cardis . | |
| 2,011,325 | 8/1935 | Rowan . | |
| 2,305,986 | 12/1942 | Ottusch | 2/103 X |
| 2,314,072 | 3/1942 | Bryant | 2/115 |
| 2,387,060 | 10/1945 | Corbi | 2/115 |
| 2,604,627 | 7/1952 | Abbott . | |
| 2,786,207 | 3/1957 | Abraham | 2/115 |
| 3,246,343 | 4/1966 | Gilligan . | |

FOREIGN PATENT DOCUMENTS

| | | | |
|---|---|---|---|
| 452464 | 11/1927 | Fed. Rep. of Germany | 2/115 |

*Primary Examiner*—H. Hampton Hunter

*Attorney, Agent, or Firm*—Michael Yakimo, Jr.

[57] ABSTRACT

An improved shirt to facilitate the wearing of a tie comprises first and second flaps attached to the respective front panels of a shirt. Upon a button/buttonhole engagement on the respective flaps, the overlapped flaps cooperate with the shirt panels to present a pocket for insertion of at least one end of the tie therein. The structure eliminates the dangling ends of the tie as well as allows the display portion of the tie to be bowed away from the shirt. As such both safety and aesthetic factors are addressed.

2 Claims, 1 Drawing Sheet

SHIRT

BACKGROUND OF THE INVENTION

This invention relates to an improved shirt, and more particularly, to a useful improvement in men's and boy's outer shirts.

In many instances certain personnel are required to wear a shirt and tie while performing their job duties. During such wear, such personnel are required to be around machinery as part of their job duties. Such dress presents an unsafe enviornment, as the tie may be caught in the machinery to the possible detriment of the wearer.

The use of clasps, holders and tie-tacs for maintaining the neck tie in place, relative to the shirt, is known. However such restraining apparatus still allows the ends of the tie to be displaced away from the shirt such that the tie ends may be caught in the machine. Also the clasp, holder or tac may eventually separate from the tie and fall in the machine which can create additional problems.

In an alternative situation, it is desirable that the display portion of the tie, i.e. that portion between the knot, and the area where the clasp is affixed thereto, be "bowed" or displaced away from the shirt front so as to present a cosmetically attractive appearance. Such a displacement is particularly desirable when a vest is being worn. In such cases it is desirable to fix a portion of the tie to the shirt so as to provide for this "bowed" display. Again a tie clasp or pin has been utilized in an attempt to provide such a desired "bowed" appearance.

Finally, it may be desirable to hold only the under end of the tie to the shirt front while allowing the top or display portion of the tie to hang free. No apparatus has been provided to provide such an affixation.

Accordingly for various reasons it is desirable to provide a shirt which holds the end or ends of a tie thereto so as to preclude the end(s) of the tie from being displaced away from the shirt front. It is also desirable to provide a shirt which displaces or "bows" the display portion of the tie from the shirt, if desired, in order to enhance the cosmetic appearance of the tie.

In response thereto I have invented a shirt which utilizes first and second flaps incorporated into the respective first and second, torso-covering panels of the shirt. Each flap presents a tuck, at the top end thereof whereupon buttoning the shirt aligns or overlaps the tucks so as to form a pocket for the insertion of the end(s) of the tie therein. Upon insertion the end of the tie is secured in the formed pocket so as to preclude its interference with machinery or the like as well as to present a desired "bowed" appearance of the display portion of the tie if so desired.

Therefore it is a general object of this invention to present an improved shirt which allows for a novel affixation of a tie end(s) thereto.

Another general object of this invention is to provide an improved shirt, as aforesaid, which enables the end(s) of the tie to be releasably secured thereto.

Still another object of this invention is to provide an improved shirt, as aforesaid, which allows for displacement of the display portion of the tie away from the chest of the wearer so as to enhance the cosmetic appearance of the display portion of the tie.

A more particular object of this invention is to provide an improved shirt, as aforesaid, which presents a pocket upon conventional shirt buttoning for insertion of a tie end(s) therein.

A still further object of this invention is to provide an improved shirt, as aforesaid, which precludes the tie ends from being caught in machinery of the surrounding work environment.

Another object of this invention is to provide an improved shirt, as aforesaid, which is simple in construction, attractive in appearance and yet effective in operation.

Other objects and advantages of this invention will become apparent from a complete reading of the specification and its accompanying claims.

DESCRIPTION OF THE PREFERRED EMBODIMENT

Figure 1:
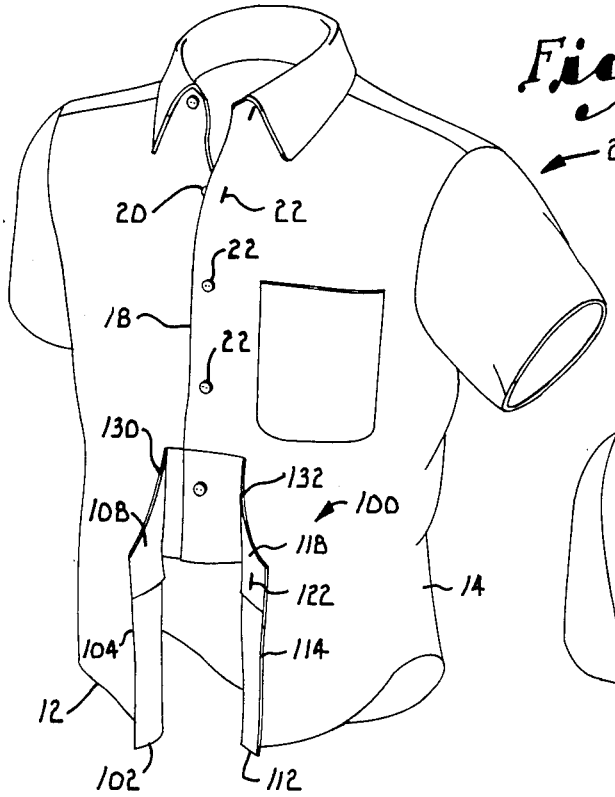
FIG. 1 is a perspective view of the improved shirt with the first and second flaps thereof being shown in an unbuttoned position.

Turning more particularly to the drawings FIG. 1 illustrates a conventional shirt 200 incorporating my invention generally designated as 100. The front torso of the shirt 200 comprises a left panel 12 and a right panel 14 having generally vertical longitudinal edges 16 and 18 respectively thereon. Along each respective edge 16, 18 is located a conventional, albeit foreshortened, button line 20/button hole 22 combination. As such, interengagement of the button 20/button hole 22 combination overlaps the left and right panels 12, 14 so as to cover the front torso of the wearer.

Mounted on the lower portion of the respective panels 12, 14 are first and second longitudinally extending flaps generally designated as 102, 112. Each flap has a vertical longitudinal edge 104, 114 with at least one button 120/button hole 122 combination respectively thereon. Each flap 102, 112 has been diagonally folded along its top edge so as to further present a tuck 108, 118 at the top end thereof. Each tuck 108, 118 presents a diagonal edge 130, 132 extending from a first point 134, 136, as laterally displaced from the respective shirt edges 16, 18 and towards a second lower point on the edges 104, 114 of the flaps 102, 112.

Figure 2:
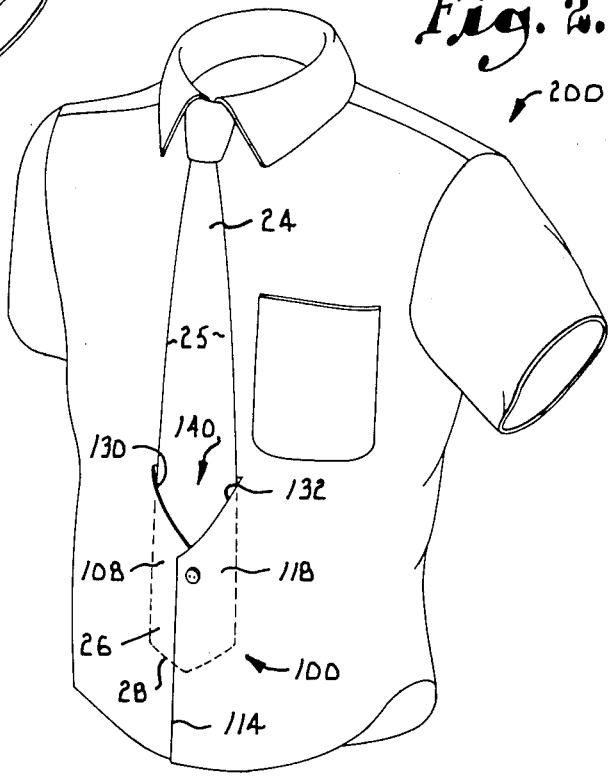
FIG. 2 is a perspective view of the shirt in FIG. 1 with the flaps being buttoned and both ends of the tie tucked into the resulting pocket.

Concurrently the above described fastening of the first flap 102 to the second flap 112 overlaps the tucks 108, 118 which aligns the respective button lines 22, 122 and edges 18, 114 and forms a pocket 140 therebetween. Pocket 140 allows for insertion of the ends(s) 26 of the tie 24 therein as shown in FIG. 2. It is understood that only the non-display, narrow end (not shown) of the tie 24 need be tucked into the pocket 140 if so desired.

As shown in FIG. 2, the intersection of the diagonal edges 130, 132 forms a V-shaped appearance which mirrors the bottom edge 28 of the tie 24 so as to enhance the aesthetic appearance of the tie 24 when tucked into the pocket 140. This relationship also enhances a tie/- shirt/coat combination as it suggests that a vest is being worn under the coat and with the tie 24.

The extension of the end(s) 26 of the tie 24 into the pocket 140 may be adjusted by the wearer between a full extension of the tie into the pocket as shown in FIG. 2 or a partial extension of the tie end (not shown) into the pocket 140. This latter extension will cause the display portion 25 of the tie 24 to be displaced from the surface of the shirt properly so that the above discussed "bowed" appearance of the display portion 25 of the tie 24 may be achieved.

Figure 3:
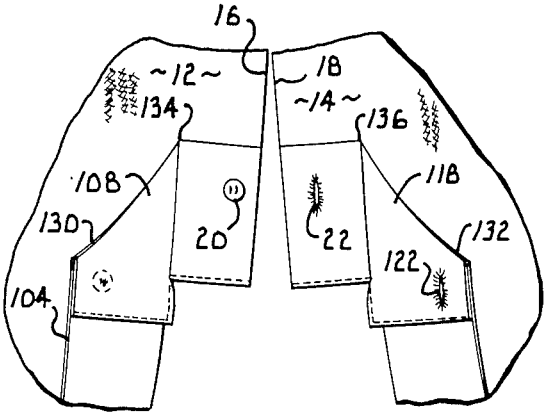
FIG. 3 is a fragmentary view, on an enlarged scale, of the panel/flap combination on the shirt shown in FIG. 1.
Figure 4:
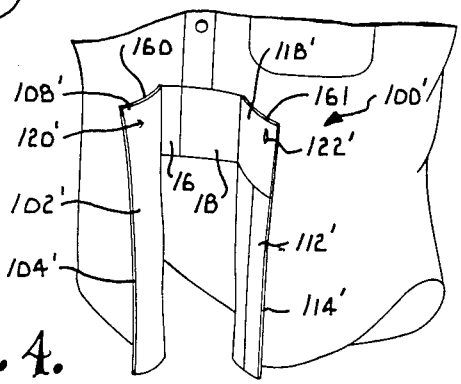
FIG. 4 is a fragmentary view illustrating an alternative form of the flap/panel combination on a shirt.
Figure 5:
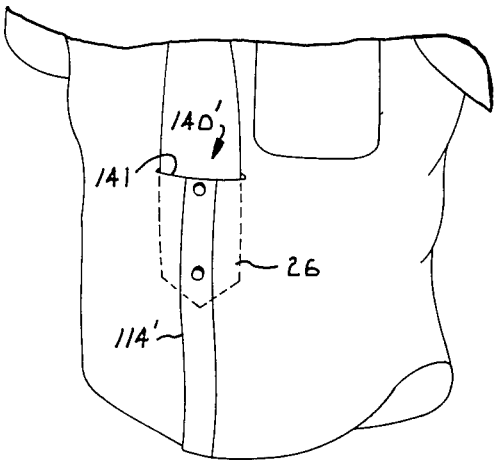
FIG. 5 is a fragmentary view of the structure of FIG. 4 in a buttoned position with both tie ends being tucked into the resulting pocket.

An alternative form the invention 100' is as shown in FIGS. 4 and 5. Such embodiment employs the use of first and second tucks 108', 118' which has horizontal edges 160, 161 instead of the diagonal edges 130, 132 as earlier described. As such the conventional fastening of the first flap 102' to the second flap 112' presents a horizontal alignment of the edges 160, 161 as opposed to the above described V-shaped appearance. Such shirt may be used when the aesthetic appearance of the shirt/tie combination is not a primary factor, such as when worn with a sweater or the like. Also a relatively tight pocket 140 is formed by the use of the horizontal edges 160, 161 such that resulting edge 141 of the pocket lies closer to the overlapped panels 16, 18 of the shirt. This tighter pocket allows the end of the tie 24 to be partially extended into the pocket 140 and held thereat. As such the desired "bowed" appearance of the display portion 25 of the tie may be more easily maintained. Accordingly it can be seen that the "tightness" of the pocket may be variously adjusted between a tight pocket 140' utilizing overlapping horizontal edges 160, 161 of FIG. 4 and a relatively loose pocket 140 by the use of diagonal edges 130, 132 as shown in FIGS. 1–3.

It is herein noted that the flaps 102, 112 may be integral with the panels 12, 14 of the shirt in order to enhance the aesthetic appearance thereof.

Although various now-preferred forms of this invention have been described, it is understood that my invention is not to be so limited except in accordance with the following claims and the equivalents thereof.

What is claimed for Letters Patent is:

1. A shirt to facilitate the wearing of a tie comprising:

a first panel having a top and bottom portion for covering the front torso of the wearer;

a button line comprising a plurality of buttons longitudinally extending along an edge of said first panel;

a second panel having a top and bottom portion for covering a portion of the front torso of the wearer;

a buttonhole line comprising a plurality of buttonholes corresponding to said buttons on said button line and longitudinally extending along an edge of said second panel;

a first flat having a top and bottom portion attached to said first panel;

a button line comprising at least one top button longitudinally extending along said first flap and generally positioned below said button line on said first panel;

a second flap having a top and bottom portion attached to said second panel;

a buttonhole line comprising at least one buttonhole longitudinally extending along said second flap and corresponding to said at least one top button line on said first flap and generally positioned below said buttonhole line on said second panel;

each of said flaps having an upper free edge generally overlapping said bottom portion of said respective panel, whereupon engagement of said respective button lines on said panels and flaps with said corresponding buttonhole lines overlaps said panels and flaps, said top portions of said overlapped flaps cooperating with said bottom portion of said overlapped panels to form a pocket having an inlet as presented by a displacement of said overlapped upper edges from said bottom portion of said panels, whereby to form an integrated button line successively extending along said shirt as interrupted by said pocket inlet for insertion of an end of a tie therein.

2. The shirt as set forth in claim 1 wherein each tuck presents a diagonal edge, whereupon said overlapping of said edges presents a V-shaped appearance to said line defining the upper edge of said pocket.

* * * * *